US005108523A

United States Patent [19]

Peterseim et al.

[11] Patent Number: 5,108,523

[45] Date of Patent: Apr. 28, 1992

[54] SHAPE MEMORY ALLOY

[75] Inventors: Jürgen Peterseim, Düsseldorf; Wolfgang Schlump, Essen, both of Fed. Rep. of Germany

[73] Assignee: Fried. Krupp GmbH, Essen, Fed. Rep. of Germany

[21] Appl. No.: 557,629

[22] Filed: Jul. 24, 1990

[30] Foreign Application Priority Data

Aug. 12, 1989 [DE] Fed. Rep. of Germany ..... 3926693
Feb. 27, 1990 [DE] Fed. Rep. of Germany ..... 4006076

[51] Int. Cl.[5] ..... C22C 19/00

[52] U.S. Cl. ..... 148/402; 420/451; 420/417

[58] Field of Search ..... 148/402; 420/451, 417

[56] References Cited

U.S. PATENT DOCUMENTS 3,832,243 8/1974 Donkersloot et al. ..... 148/402
4,283,233 8/1981 Goldstein ..... 148/11.5 R
4,950,340 8/1990 Wakita et al. ..... 148/402

FOREIGN PATENT DOCUMENTS 0047639 3/1982 European Pat. Off. .
0086013 8/1983 European Pat. Off. .
0187452 7/1986 European Pat. Off. .
2105555 9/1971 Fed. Rep. of Germany .
2133103 2/1972 Fed. Rep. of Germany .
3007307 7/1981 Fed. Rep. of Germany .
2389990 12/1978 France .
59-150069 8/1984 Japan ..... 148/402

OTHER PUBLICATIONS

*Shape Memory Alloys*, ed. Hiroyasu Funakubo, pp. 84–85, 1987.

Eckelmeyer et al, "The Effect of Alloying on the Shape Memory Phenomenon in Nitinol", Scripta MET. vol. 10, 1976 pp. 667–672.

Kleinherenbrink et al "Control of the Transformation Temperatures of TiNi Shape Memory Alloys by Ternary Additions", Martensitic Transformation in Science & Technology, Mar. 1989, pp. 187–190.

Duerig et al, "A Shape-Memory Alloy for High Temperature Applications", Journal of Metals 34, Dec. 1982, pp. 14–20.

"Shape Memory Effects in Alloys", *Plenum Press*, the Metallurgical Society of AIME Symposium in Toronto, Ontario, Canada, May 19–22, 1975, five pages.

EPO Search Report, EP 90 11 4034.3, Jan. 8, 1991, four pages.

*Primary Examiner*—Deborah Yee
*Attorney, Agent, or Firm*—Spencer, Frank & Schneider

[57] ABSTRACT

A shape memory alloy for repeated use, containing no noble metals. NiTiZr and NiTiZrCu shape memory alloys having $A_s$ temperature which lies above 100° C. are disclosed. These shape memory alloys have the following composition: 41.5 to 54 atomic % Ni; 24 to 42.5 atomic % Ti and 7.5 to 22 atomic % Zr.

9 Claims, No Drawings

SHAPE MEMORY ALLOY

CROSS-REFERENCE TO RELATED APPLICATIONS

This application claims the priority of Federal Republic of German applications Ser. Nos. P 39 26 693.1 filed Aug. 12th. 1989 and P 40 06 076.4 filed Feb. 27th, 1990, which are incorporated herein by reference.

BACKGROUND OF THE INVENTION

The present invention relates to a shape memory alloy for repeated use and containing no noble metals.

For commercial applications of shape memory alloys characterized by the omission of noble metals, generally only NiTi, CuZnAl and CuAlNi have been available.

NiTi shape memory alloys are known to have excellent properties. With an almost stoichiometric composition, they are characterized by a particularly high degree of reversible deformation with a one-way or two-way effect, by high tensile strength and ductility and by very good corrosion resistance. Moreover, when exposed to thermal cycling these shape memory alloys exhibit excellent stability of the magnitude of their shape memory effect. In addition, they can be heated relatively far beyond the temperature of the completion of austenite formation, $A_f$, without the occurrence of damaging irreversible lattice changes which reduce the magnitude of the shape memory effect or inadvertently shift the transformation temperature.

To utilize the two-way effect, the temperature at which austenite formation begins, $A_s$, should be relatively high, for example above 100° C. However, the maximum attainable $A_s$-temperatures for NiTi shape memory alloys for repeated applications are below 100° C.

Hereinafter the applicable $A_s$ temperature is considered to be that temperature which appears after several thermal cycles.

In the literature, the addition of zirconium as a third element in the place of titanium to raise the transformation temperature is disclosed. Eckelmeyer, in Scripta Met. 10 (1976), pages 667–672, discloses the effect of up to 2 atomic % Zr added instead of Ti. According to this article, the transformation temperature is raised by about 42° C. per atomic % Zr. The highest $A_s$ temperature values measured lie at about 105° C. for the one-way effect with 2 atomic % Zr; however, it was not clear whether $A_s$, $A_f$ or a value therebetween was being measured. This publication does not consider alloys having greater Zr contents than 2 atomic percent.

Based on the above work Kleinherenbrink et al. examined and reported in The Martensitic Transformation in Science and Technology, given at a conference in Bochum, FRG, on Mar. 9–10, 1989, shape memory alloys including up to 1.5 atomic % Zr. No increased transformation temperature could be measured, that is, the result of the first-noted publication could not be confirmed.

At present, only shape memory alloys of a CuAlNi system are commercially applicable for repeated applications having an $A_s$ temperatures above 100° C., as disclosed by Duerig Albrecht and Gessinger in A Shape Memory Alloy for High Temperature Applications, Journal of Metals 34 (1982), pages 14–20. With these alloys, $A_s$ temperatures up to 175° C. can be attained; however, these alloys exhibit significant drawbacks. For example, the maximum two-way effect is only 1.2%; elongation at rupture is low (5 to 7%), and tolerance of overheating is noticeably less than for NiTi shape memory alloys. Further, the low effect-stability is unfavorable for repeated applications: a significant decrease in the degree of reversible deformation occurs after only a few hundred temperature cycles.

In the past, no commercially usable shape memory alloy based on NiTi has been known which had an $A_s$ temperature of more than 100° C., though the potentially favorable characteristics of such alloys has prompted the expenditure of considerable efforts.

SUMMARY OF THE INVENTION

It is an object of the present invention to provide a shape memory alloy based on NiTi which, at an $A_s$ temperature of more than 100° C. has good values for the two-way effect, the elongation at rupture, the tolerance to being overheated and the reversible deformation.

This object and others to become apparent as the specification progresses are achieved by the invention, according to which, briefly stated, a shape memory alloy having an $A_s$ temperature above 100° C. is composed of 41.5 to 54 atomic % Ni, 24 to 42.5 atomic % Ti and 7.5 to 22 atomic % Zr.

This shape memory alloy may be favorably modified with additionally up to 8.5 atomic % Cu.

DETAILED DESCRIPTION OF THE PREFERRED EMBODIMENTS

The shape memory alloys of the present invention are obtained by standard techniques from suitable starting melts or prealloys by remelting in graphite crucibles placed in an argon atmosphere in a vacuum induction furnace. The starting melts or prealloys are of a composition that a reaction with the graphite crucible is substantially suppressed.

Unexpectedly, shape memory alloys of the composition range of the present invention have shape memory characteristics with transformation temperatures that are noticeably higher than those of binary NiTi shape memory alloys.

The shape memory alloys according to the invention are ductile and can be deformed at room temperatures if, due to their composition, they have a single phase structure. The concentration limit for the intermetallic phase of NiTiZr or NiTiZrCu under the selected manufacturing conditions approximately follows these relationships:

$$\text{Ni (atomic percent)} = 50.8 + 0.045\ \text{Zr (atomic percent)}$$

for the case of ternary alloys and $$\text{Ni} + \text{Cu (atomic percent)} = 50.8 + 0.045\ \text{Zr (atomic percent)}$$

for the case of quaternary alloys.

Shape memory alloys of the present invention can exhibit especially advantageous characteristics when composed of 24 to 34 atomic % Ti and 16 to 22 atomic % Zr. With a Zr percentage of 16 atomic %, the $A_s$ temperature lies above 20° C.; for a Zr percentage of 20 atomic %, it lies above 145° C.

The shape memory alloy according to the present invention may also be advantageously have a combined Ni plus Cu percentage of 47 to 50 atomic %, 48 to 49.5 atomic % or 48.5 to 49 atomic %.

Additionally, within the above composition ranges the Zr percentage may advantageously be between 10 and 19 atomic % or between 14 and 18 atomic %.

A shape memory alloy having particularly favorable characteristics ca be produced with the following composition: 48.5 to 49 atomic % Ni; 24 to 42.5 atomic % Ti and 14 to 18 atomic % Zr.

A property of the element Zr of forming a shape memory alloy with Ni and Ti which has an increased transformation temperature above 100° C., also applies for elements similar to Zr, such as, in particular, Hf. Thus, it is within the scope of the present invention to possibly replace Zr with Hf or similar elements.

Tables 1 and 2 below show exemplary shape memory alloys according to the invention and their $A_s$ temperatures. Table 2 also gives an example of a binary NiTi shape memory alloy whose $A_s$ temperature, as expected, lies below 100° C.

The embodiments in Tables 1 and 2 show an $A_s$ temperatures rise with increasing Zr percentage. In case of more than 16 atomic % Zr, the $A_s$ temperature lies above 120° C.; with more than 20 atomic % Zr, the $A_s$ temperature is higher than 150° C.

TABLE 1

| | NiTiZrCu Alloys (in atomic %) and their transformation temperatures (in °C.)* | | | | | |
|---|---|---|---|---|---|---|
| No. | Ni | Ti | Zr | Cu | $A_s$ | $A_f$ |
| 1 | 47.2 | 39.8 | 10.8 | 1.9 | 102 | 142 |
| 2 | 45.2 | 34.8 | 16.3 | 3.5 | 125 | 152 |
| 3 | 43.1 | 31.2 | 20.1 | 5.4 | 158 | 210 |
| 4 | 42.5 | 39.9 | 11.1 | 6.3 | 100 | 134 |
| 5 | 41.5 | 34.1 | 16.1 | 8.1 | 122 | 146 |

*(remainder: interstitial and manufacture specific impurities)

TABLE 2

| | NiTiZr Alloys (in atomic %) and their transformation temperatures (in °C.)* | | | | |
|---|---|---|---|---|---|
| No. | Ni | Ti | Zr | $A_s$ | $A_f$ |
| 1 | 49.1 | 50.8 | 0 | 85 | 116 |
| 2 | 47.9 | 37.9 | 14.0 | 122 | 165 |
| 3 | 48.9 | 40.1 | 10.8 | 108 | 152 |
| 4 | 48.8 | 34.9 | 16.1 | 132 | 180 |
| 5 | 48.6 | 31.0 | 20.2 | 170 | 230 |

*(remainder: interstitial and manufacture specific impurities)

In addition to the transformation temperatures $A_s$ and $A_f$, the magnitude of the shape memory effect, that is, the extent of reversible deformation, constitutes another significant feature.

Since the shape memory effect drops with increasing Zr percentage, only some of the shape memory alloys listed in the tables have a Zr percentage in the order of magnitude of about 20 atomic %.

Eventually higher transformation temperatures ($A_s$, $A_f$) than those listed in the tables can be realized by replacing the element Zr with Hf, the other components and their percentage of the concerned shape memory alloy being unchanged. This effect occurs at least with shape memory alloys having a Hf percentage in the range of 14 to 17 atomic %.

Prealloys of the composition according to the invention are produced in a button furnace and are remelted into cylindrical samples in graphite crucibles in a vacuum induction furnace under an argon atmosphere. The transformation temperatures $A_s$ and $A_f$ listed in the tables were determined calorimetrically from the samples in the cast state after several thermal cycles.

It will be understood that the above description of the present invention is susceptible to various modifications, changes and adaptations, and the same are intended to be comprehended within the meaning and range of equivalents of the appended claims.

What is claimed is:

1. A shape memory alloy having a starting temperature at austenite formation above 100° C., comprising 41.5 to 54 atomic % Ni, 24 to 42.5 atomic % Ti and 14 to 22 atomic % of at least one element selected from the group consisting of Zr, Hf, and a mixture of Zr and Hf.

2. A shape memory alloy as defined in claim 1, further comprising up to 8.5 atomic % Cu.

3. A shape memory alloy as defined in claim 2, wherein a combined Ni + Cu content is 48.5 to 49 atomic %.

4. A shape memory alloy as defined in claim 2, wherein a combined Ni + Cu content is 47 to 50 atomic %.

5. A shape memory alloy as defined in claim 2, wherein a combined Ni + Cu content is 47 to 50 atomic %.

6. A shape memory alloy as defined in claim 1, wherein the Ti content is 24 to 34 atomic % and said element is present in the amount of 16 to 22 atomic %.

7. A shape memory alloy as defined in claim 1, wherein the Ti content is 24 to 30 atomic % and said element is present in the amount of 20 to 22 atomic %.

8. A shape memory alloy as defined in claim 1 wherein said element is present in the amount of 14 to 19 atomic %.

9. A shape memory alloy as defined in claim 1 wherein said element is present in the amount of 14 to 18 atomic %.

* * * * *